US005782107A

United States Patent [19]

Glanz

[11] Patent Number: 5,782,107

[45] Date of Patent: Jul. 21, 1998

[54] NOVELTY JEWELRY CONSTRUCTION

[76] Inventor: Andrew Glanz, 3005 Shore Dr., Merrick, N.Y. 11566

[21] Appl. No.: 633,290

[22] Filed: Apr. 16, 1996

[51] Int. Cl.[6] ..... A44C 5/14; A44C 7/00

[52] U.S. Cl. ..... 63/3; 63/3.1; 63/12

[58] Field of Search ..... 63/3, 4, 7, 10, 63/DIG. 3, 12, 14.1; 24/615, 616, 324, 3.3, 31 C

[56] References Cited

U.S. PATENT DOCUMENTS

| | | | |
|---|---|---|---|
| 843,243 | 2/1907 | Allenthin | 63/10 |
| 4,311,149 | 1/1982 | Panici | 63/DIG. 3 |
| 4,317,337 | 3/1982 | Walden et al. | 63/3 |
| 4,768,688 | 9/1988 | Harrigan | 63/3 X |
| 5,323,554 | 6/1994 | MacDonald | 63/3 X |
| 5,367,891 | 11/1994 | Furuyama | 63/3 X |

*Primary Examiner*—Kien T. Nguyen

[57] ABSTRACT

A costume jewelry item comprises a length of flexible transparent tube into which is loaded a flowable decorative material, such as sand. The nature of the flowable material is preferably varied, as by color, along the length of the tube to provide a pleasing design or appearance which can be viewed through the tube. Closures seal the ends of the tube and allow their interconnection to allow bracelets, necklaces and the like to be formed.

6 Claims, 2 Drawing Sheets

NOVELTY JEWELRY CONSTRUCTION

The present invention relates to a new and improved construction for jewelry items, and particularly jewelry items that are well suited for assembly as a craft item, as by children.

BACKGROUND OF THE INVENTION

The use of necklaces, anklets, pendants and bracelets as items of adornment is well known. Such items each comprise an elongated member suitably finished or adorned to create an attractive accessory for the wearer. Often such members are of a metal fabrication, typically being formed of chain of precious metal, such as gold or silver. Alternatively, such bracelets may be formed of other soft, pliable material, such as leather, string or threads, either individually or together to form a pleasing pattern and surface texture.

It is also well known to provide individual components to make jewelry items in the form of a set or kit. Often such kits are marketed as activity sets for children. Such a targeted market precludes the use of expensive components, thus militating against the use of gold, silver and the like. Typical jewelry craft sets or kits thus comprise threads and cords from which the bracelets, necklace and the like can be formed, along with beads and other items to be placed on the strands. The user may be instructed as to how to wind or weave individual elements together in a variety of design.

Because of the limitations to the design and patterns which may be formed from conventional jewelry craft kits, it is a purpose of the present invention to provide a new and improved jewelry construction which may be utilized for the construction of a variety of jewelry items, including bracelets, pendants, necklaces and the like.

A further purpose of the present invention is to provide a jewelry construction which may be easily implemented and thus allows the resulting jewelry creations to be formed by users with little formal training.

A further purpose of the present invention is to provide a jewelry structure which may be utilized to create a wide variety of jewelry designs and which may be implemented inexpensively and efficiently.

BRIEF DESCRIPTION OF THE INVENTION

In accordance with the foregoing and other objects and purposes, jewelry constructed in accordance with the present invention comprises an elongated member formed of a clear, flexible tubular element. The flexible tubular element is filled with a decorative material, such as colored granules, in a chosen design and pattern. The pattern can be viewed through the wall of the tubular element. The ends of the tube are closed with plug elements, which both seal the ends and which may provide for an interlocking function. The resulting jewelry item is thus easily constructed and is attractive, and may be made in an almost limitless variety of patterns and designs.

BRIEF DESCRIPTION OF THE DRAWINGS

A fuller understanding of the present invention and the features and benefits pertinent thereto will be made apparent upon consideration of the following detailed description of a preferred, but nonetheless illustrative embodiment of the invention, when reviewed in conjunction with the annexed drawings, wherein.

DETAILED DESCRIPTION OF THE INVENTION

Figure 1:
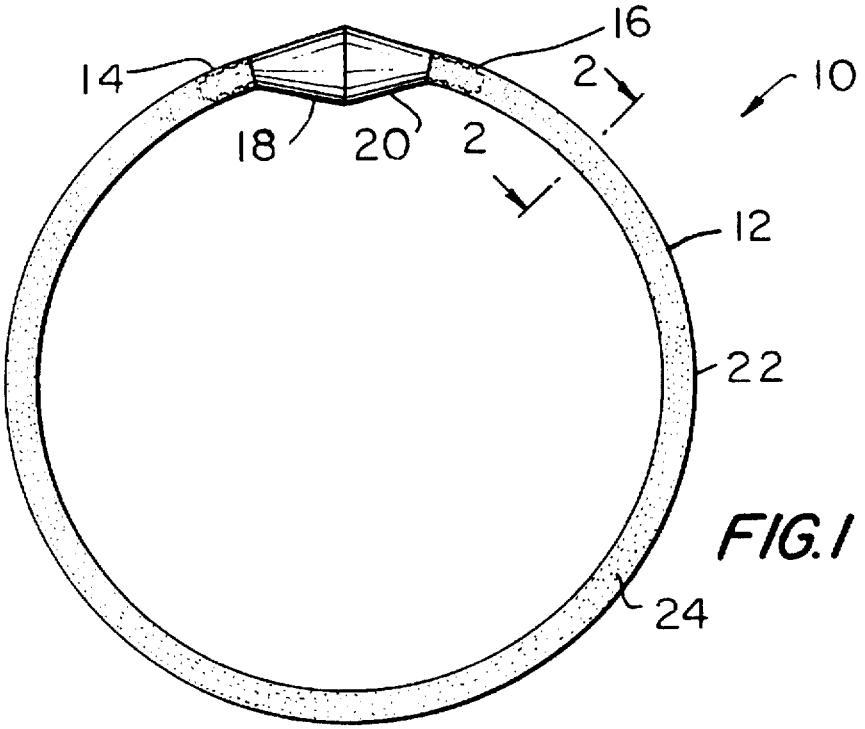
FIG. 1 is an elevation view of a necklace formed in accordance with the invention.
Figure 2:
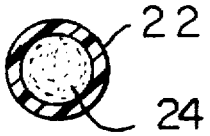
FIG. 2 is a view taken in section along line 2—2 of FIG. 1.

Referring initially to FIG. 1, a jewelry item 10 constructed in accordance with the present invention includes an elongated decorative member 12 having first and second ends 14, 16, terminated and formed by combination plug/connectors 18, 20, respectively. The elongated decorative member 12 may be the form of a clear, flexible, plastic tube 22 filled with a decorative material 24, the appearance of which can be seen through the clear wall of the tube 22.

The plastic tube 22 may be of any of a known form of thin, plastic tubing, typically with an outer diameter in the range of approximately 0.25 inch. The decorative material may be any of a variety of flowable materials, such as colored sand, metallic-finish chips, which may be of plastic or the like, chosen for their attractive surface finish and color, or other powder or granular materials able to be loaded into the tube. One or more liquids can also be used. If liquids are used, they may be chosen to be immiscible with each other to define different "layers" or portions within the tube, and may be colored as appropriate. The material is loaded into the tube as desired. A funnel may be used to facilitate the loading. The distal end of the tube is sealed to prevent the loaded material from exiting. A first plug member, as shall be subsequently discussed, can be used to close the end. As may be appreciated, the decorative mixture which fills the tubing may vary along the length of the tubing, allowing a variety of patterns and colors to appear and to be arranged along the tubing's length. It is contemplated, for example, that the user would be provided with a plurality of differently-colored materials, such as sand, the loading of which into the tube would be varied and alternated at the choice of the user until the length of tube is filled.

Figure 3:
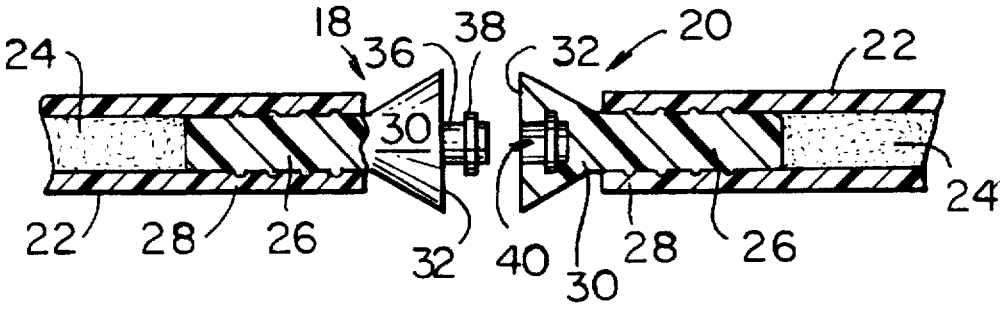
FIG. 3 is a detailed section view of a portion of the necklace of FIG. 1 illustrating the termination of an end of the tubular member.

After filling the tube is sealed, and formed into a closed loop shape, by use of the plug members 18 and 20, which are depicted in a large scale in FIG. 3. As shown therein, the plugs, which may be formed of plastic, each include a shank portion 26 dimensioned to fit securely within the inner diameter of the tube 22. The shank may be provided with a series of ridges or threads 28 which enhance the grip of the plug into the resilient tubing sidewall. A tapered main body portion 30 connects to the shank 26. In order to allow the plugs to be coupled together, the connector 18 terminates in a face 32. Extending from the face is connector 34, which includes a shank 36 having a shoulder element 38. The second plug 20 includes a bore 40 inwardly from face 32 of body portion 30, the base being adapted to receive the connector portion 34 of the other plug, the bore having a peripheral groove 42 to accept shoulder 38 in a snap-fit relationship. Depending on the length of the created loop, the jewelry item may be used as a necklace, bracelet, or anklet.

Figure 4:
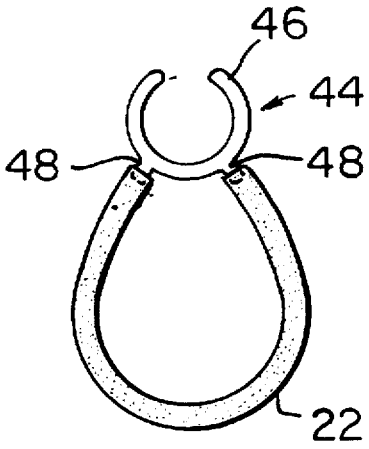
FIG. 4 is an elevation view of a first alternative form of jewelry created in accordance with the invention.

In the embodiment presented in FIG. 4, a jewelry item in accordance with the present invention may take the form of a pendant or earring. As shown therein, the plastic tube 22 is sealed at its ends by a single plug member 44, comprising a clip portion 46 adapted and constructed to allow the jewelry item to be clipped about another item, and a pair of tube-engaging plug portions 48. The plug portions may be provided with ridges along their shaft to enhance their respective connection with the ends of the tubing. It is to be recognized that the plug member 44 may be inserted into one end of the length of tubing before the tubing is filled, followed by closing the other end after filling is completed.

Figure 5:
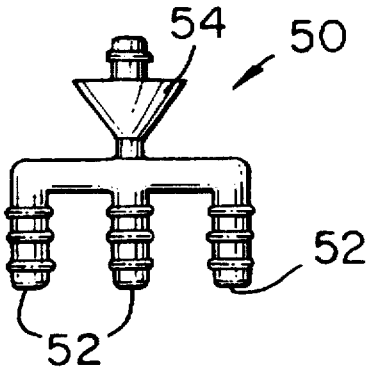
FIG. 5 is an elevation view of an alternative connector for use in connection with the invention.

Other plugs may be used to form a variety of jewelry designs. In FIG. 5, the plug member so allows three strands or tubes to be run between mating plugs, thus increasing the variety of designs available for construction. The plug member 50 includes three parallel shanks 52, each adapted to grip and seal an end of a tubing length. The shanks adjoin the connector portion 54, which is adapted to mate with a similar connector on a second plug affixed upon the opposed ends of the tubing lengths. The individual tubing elements between the plug can be of the same or difference lengths. In addition, the tubing, and thus their respective shanks, may be of different diameters to further provide variety to the jewelry items constructed.

It is to be appreciated that the present invention allows a wide variety of jewelry items to be fabricated using materials which are especially well-suited for use by children and others as a craft-type item. The full scope of the invention is to be measured by the annexed claims.

I claim:

1. A costume jewelry article, comprising a length of flexible, transparent tube having first and second ends; flowable decorative material arranged within the tube to substantially fill the tube; and a pair of mating connector closures for the first and second ends of the tube to join said ends of said tube into a closed loop, said closures each comprising a ridged shank to grip an inside surface of one of said first and second ends of said tube and an outwardly-flared body portion bearing a mating connector element.

2. The article of claim 1, wherein said flowable material comprises sand.

3. The article of claim 1, wherein said flowable decorative material comprises a plurality of different granular materials, said different granular materials being arranged in consecutive bands within said tube.

4. The article of claim 1, wherein said flowable material comprises a plurality of immiscible liquids.

5. A costume jewelry article, comprising a plurality of lengths of flexible, transparent tube, each length having first and second ends; flowable decorative material arranged within the tubes to substantially fill the tubes; and a pair of mating connector closures for the first and second ends of the tubes to join the ends of said tubes into closed loops, said closures each comprising a plurality of parallel aligned ridged shanks to grip inside surfaces of one of said first and second ends of said tubes, an intermediate member joining said shanks, and an outwardly-flared body portion bearing a mating connector element.

6. A costume jewelry article, comprising a length of flexible, transparent tube having first and second ends; flowable decorative material arranged within the tube to substantially fill the tube; and a closure for the first and second ends of the tube to join said ends of said tube into a closed loop, said closure comprising a generally C-shaped clip of a resilient material having an open portion dimensioned to permit affixation of the clip upon the earlobe of a wearer, and a pair of spaced shanks projecting outwardly from said clip to grip an inside surface of said first and second ends of said tube.

* * * * *